US006223673B1

(12) United States Patent
Mears et al.

(10) Patent No.: US 6,223,673 B1
(45) Date of Patent: May 1, 2001

(54) FLOATABLE RECREATIONAL PARK

(75) Inventors: Norman P. Mears, Mahtomedi; Patrick S. Golden, White Bear Township, both of MN (US); Charles P. Brewer; Kirk M. Johnsen, both of Linn Creek, MO (US); Leo A. Riley, Seal Beach, CA (US); Ronald D. Romens, Verona, WI (US); Jeffrey J. Carlson, Minneapolis; Wendell L. King, Pillager, both of MN (US)

(73) Assignee: Rave Sports Inc., St. Paul, MN (US)

( * ) Notice: Subject to any disclaimer, the term of this patent is extended or adjusted under 35 U.S.C. 154(b) by 0 days.

(21) Appl. No.: 09/365,111

(22) Filed: Jul. 30, 1999

(51) Int. Cl.[7] ..... B63B 35/73; A63G 4/00; A63B 5/11

(52) U.S. Cl. ..... 114/264; 441/129; 472/116; 472/128; 482/27; 482/29

(58) Field of Search ..... 482/27, 29; 472/128, 472/129, 116; 114/264, 362, 346, 345, 61.23; 441/38, 39, 40, 66, 67, 129; 193/25 B; 182/48; 244/905

(56) References Cited

U.S. PATENT DOCUMENTS

| | | | | |
|---|---|---|---|---|
| Re. 30,344 | | 7/1980 | McNeil | 272/65 |
| 2,324,970 | * | 7/1943 | Woolley | 482/29 |
| 2,508,915 | | 5/1950 | Hardie . | |
| 2,855,134 | | 10/1958 | Arnold . | |
| 3,767,192 | | 10/1973 | Eriksson | 272/65 |
| 4,018,321 | * | 4/1977 | Fisher | 193/25 B |
| 4,332,049 | * | 6/1982 | Fisher | 441/80 |
| 4,576,375 | | 3/1986 | Roberts | 272/65 |
| 5,297,978 | * | 3/1994 | Ramsey | 441/131 |
| 5,301,630 | * | 4/1994 | Genovese | 114/375 |
| 5,385,518 | | 1/1995 | Turner | 482/27 |
| 5,810,695 | | 9/1998 | Sass | 482/27 |

FOREIGN PATENT DOCUMENTS

| | | | |
|---|---|---|---|
| 473 445 A1 | * | 3/1992 | (EP) . |
| 0 473 445 A1 | | 3/1992 | (EP) . |
| 786 270 A1 | * | 7/1997 | (EP) . |

OTHER PUBLICATIONS

Personal Water Park Aqua Jump Attachments, Rave Sports.*
Declaration of Ronald D. Romens (3 pages).
Declaration of Norman P. Mears (2 pages).

* cited by examiner

*Primary Examiner*—Sherman Basinger
(74) *Attorney, Agent, or Firm*—Allison Johnson, P.A.

(57) ABSTRACT

A floatable park that includes a trampoline and a first inflatable object attached to the trampoline. The first inflatable object is constructed to support a human being thereon. The park is floatable on water.

55 Claims, 9 Drawing Sheets

FLOATABLE RECREATIONAL PARK

BACKGROUND OF THE INVENTION

The invention relates to a floatable recreational park.

Floatation devices such as inner tubes and rafts have been used for years on lakes and rivers to enhance the enjoyment thereof. More recently, trampolines capable of floating on a body of water have been added to the world of outdoor water activities. These floatable trampolines are constructed such that a user can jump from the mat, i.e., jumping surface, of the trampoline and land on the mat, the inner tube, or in the body of water.

SUMMARY

In one aspect, the invention features a floatable park that includes a trampoline and a first inflatable object attached to the trampoline, where the first inflatable object is constructed to support a human being thereon, and the park is floatable on water.

In one embodiment, the park further includes a strap extending from the first inflatable object to the trampoline. In another embodiment, the strap extends in a loop around the trampoline. In other embodiments, the park further includes a buckle secured to one end of the strap. In some embodiments, the park further includes a plurality of rings secured to the first inflatable object, and a plurality of straps, wherein individual straps pass through individual rings and are secured to the trampoline. The rings can define a shape selected from the group consisting of rectangle, square, triangle, D, and circle.

In another embodiment, the first object further includes a first component attached to the first object, where the first component is capable of attaching the first object to the trampoline. The first component can be selected from the group consisting of a male component and a female component. In one embodiment, the park further includes a strap having a first end and a second end, and a second component secured to the first end of the strap and being capable of connecting with the first component.

In other embodiments, the first inflatable object further includes an anchor secured to the first inflatable object. The first inflatable object can also include an anchoring ring attached to the water-contacting surface of the first inflatable object. In another embodiment, the first inflatable object further includes an anchor and a line extending from the anchoring ring to the anchor.

In some embodiments, the first inflatable object is cylindrical in shape. In other embodiments the first inflatable object is pillow shaped. In one embodiment, the first inflatable object includes a plurality of chambers.

In another embodiment, the park further includes an apron attached to the inflatable object. The apron can extend from the first inflatable object to the trampoline. In one embodiment, the park further includes a line passing through holes in the apron to the trampoline so as to attach the apron to the trampoline.

In yet another embodiment, the first inflatable object is a slide. The slide can include a first floatable member, a second floatable member adjacent the first floatable member, and a sheet extending across the first floatable member and the second floatable member. In one embodiment, the first floatable member is inflatable. In another embodiment, the first floatable member is a cylinder.

In one embodiment, the first floatable member includes a first longitudinal extent and a second longitudinal extent extending at an angle to the first longitudinal extent, and the second floatable member includes a first longitudinal extent and a second longitudinal extent extending at an angle to the first longitudinal extent. In other embodiments, the slide further includes a plurality of straps attached to the sheet. In one embodiment, the slide further includes a ring attached to one of the first floatable member or the second floatable member, and a strap extending through the ring to secure the slide to the trampoline. The slide can also include an anchoring ring attached to a water-contacting surface of the slide.

In some embodiments, the park further includes a ladder attached to the trampoline, the ladder having a curved portion and a substantially linear portion. In other embodiments, the park further includes a second inflatable object secured to the trampoline, the second inflatable object being constructed to support a human being positioned thereon. The second inflatable object can be in the shape of a cylinder. In preferred embodiments, the shape of the second inflatable object is different from the shape of the first inflatable object.

In one embodiment, the trampoline includes a continuous tube defining an aperture, an annular frame coextensive with the aperture, and a mat attached to the frame and extending across the aperture. In some embodiments, the park further includes a strap extending from the first inflatable object and around the tube. In other embodiments, the strap extends from the first inflatable object and to the frame. In still other embodiments, the park further includes a first strap extending from the first inflatable object and around the tube, and a second strap extending from the first object and around the frame. In another embodiment, the park further includes an apron extending from the first inflatable object to the trampoline. The park can also include a line passing through holes in the apron and around the frame. In one embodiment, the continuous tube includes a plurality of chambers.

In another aspect, the invention features a slide that includes a first floatable member, a second floatable member adjacent the first inflatable member, and a sheet extending across the first floatable member and the second floatable member. In one embodiment, the first floatable member includes a cylinder. In another embodiment, the first floatable member includes an inflatable tube. The first floatable member can include a first cylindrical portion and a second cylindrical portion extending at an angle to the first cylindrical portion. In some embodiments, the slide further includes a strap extending from a first edge of the sheet to a second edge of the sheet.

In another aspect, the invention features a method of using a floatable park as described above where the method includes placing the floatable park on a body of water. In one embodiment, the method further includes contacting a surface of the park with a human being.

The floatable recreational park floats on a body of water and provides a user with a variety of entertainment options. The trampoline provides a central, stable structure to which the inflatable objects can be secured. The user can travel from the trampoline to the inflated floatable objects that are attached to the trampoline. The user can attempt to climb the park from any one of the attached floatable objects. In addition, a user can jump from the jumping surface of the trampoline and land on the various inflated objects. The greater the variety of inflated objects attached to the trampoline, the greater the variety of entertainment.

A giant pillow, a cylindrical tube, and a slide are three examples of the various inflatable, floatable objects that can be included in the park. A first user, positioned at the end of the giant pillow that is farthest from the trampoline, can be ejected off of the pillow by a second person landing on the end of the pillow that is closest to the trampoline. Users can also slide from the slide directly into the water. The additional inflated floatable objects also create additional space for more users to simultaneously enjoy the park.

Other features and embodiments are described in the preferred embodiments and in the claims. Like reference numbers and designations in the various drawings indicate like elements.

DETAILED DESCRIPTION

Figure 1:
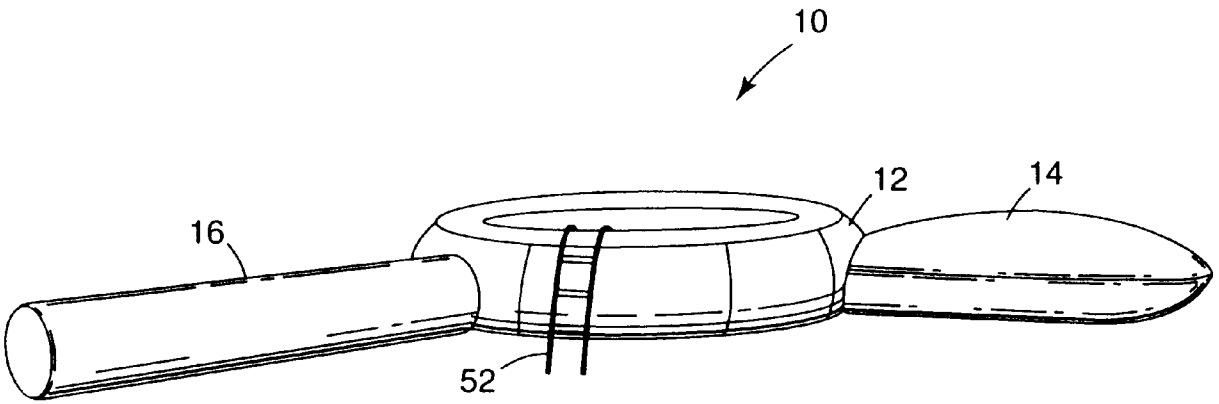
FIG. 1 is a floatable recreational park, according to one embodiment of the invention, that includes a trampoline, a first inflatable object and a second inflatable object.
Figure 5:
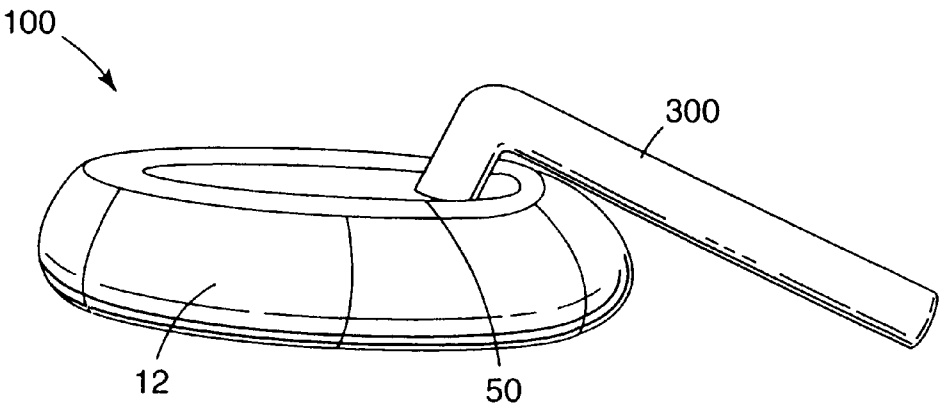
FIG. 5 is a perspective view of an inflatable, floatable recreational park according to a second embodiment of the invention, including a slide attached to a trampoline.
Figure 2H:
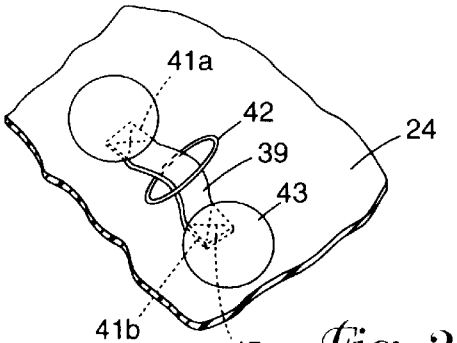
FIG. 2H is a perspective top view of a ring affixed to the trampoline of FIG. 2A.
Figure 2E:
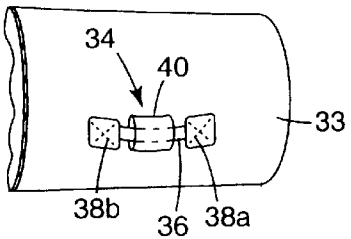
FIG. 2E is an enlarged view of a handle on a side of the trampoline of FIG. 2A.
Figure 2I:
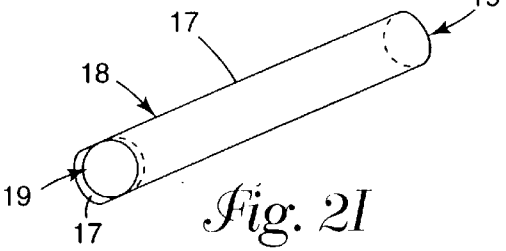
FIG. 2I is a perspective view of a chamber of one embodiment of the tube of the trampoline of FIG. 2A.
Figure 2C:
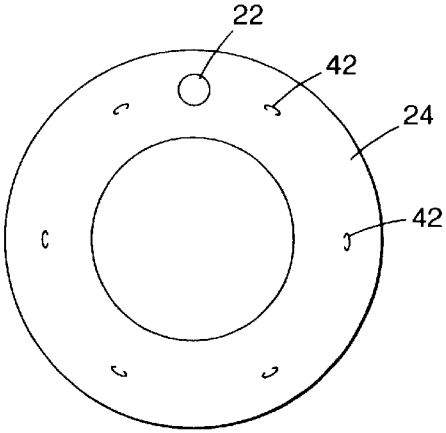
FIG. 2C is a bottom view of the tube of the trampoline of FIG. 2A.
Figure 2D:
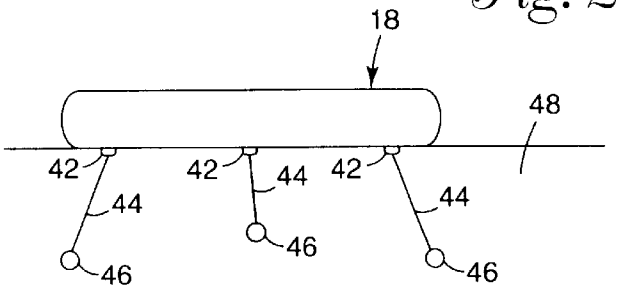
FIG. 2D is a side view of the trampoline of FIG. 2A floating on a body of water.
Figure 2A:
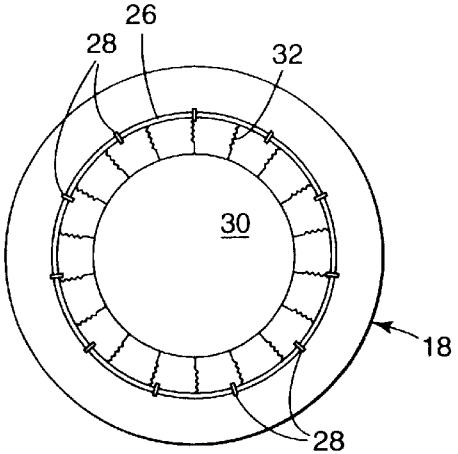
FIG. 2A is a top view of the trampoline of the park of FIG. 1.
Figure 2B:
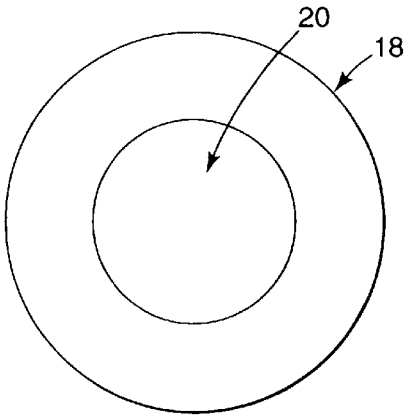
FIG. 2B is a top view of the tube of the trampoline of FIG. 2A.
Figure 2G:
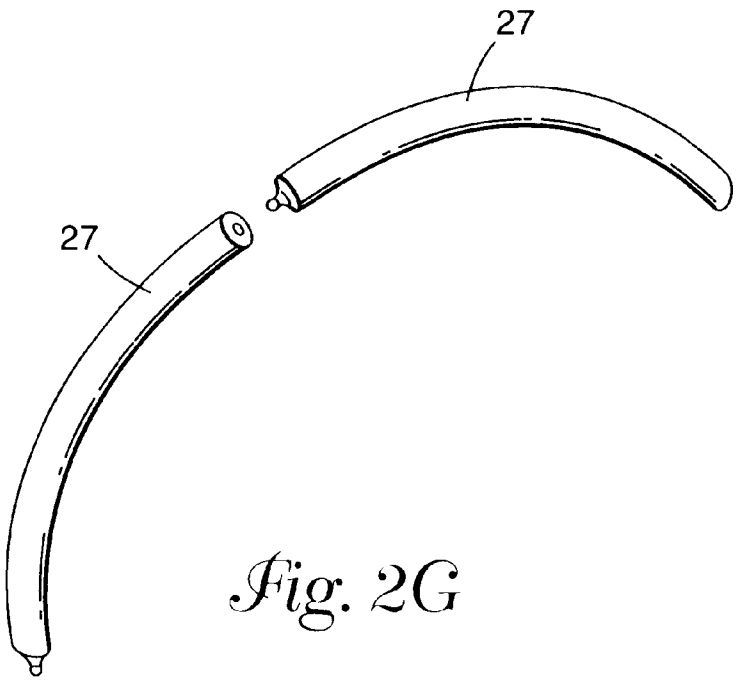
FIG. 2G is a view of components of the frame of FIG. 2F.
Figure 2F:
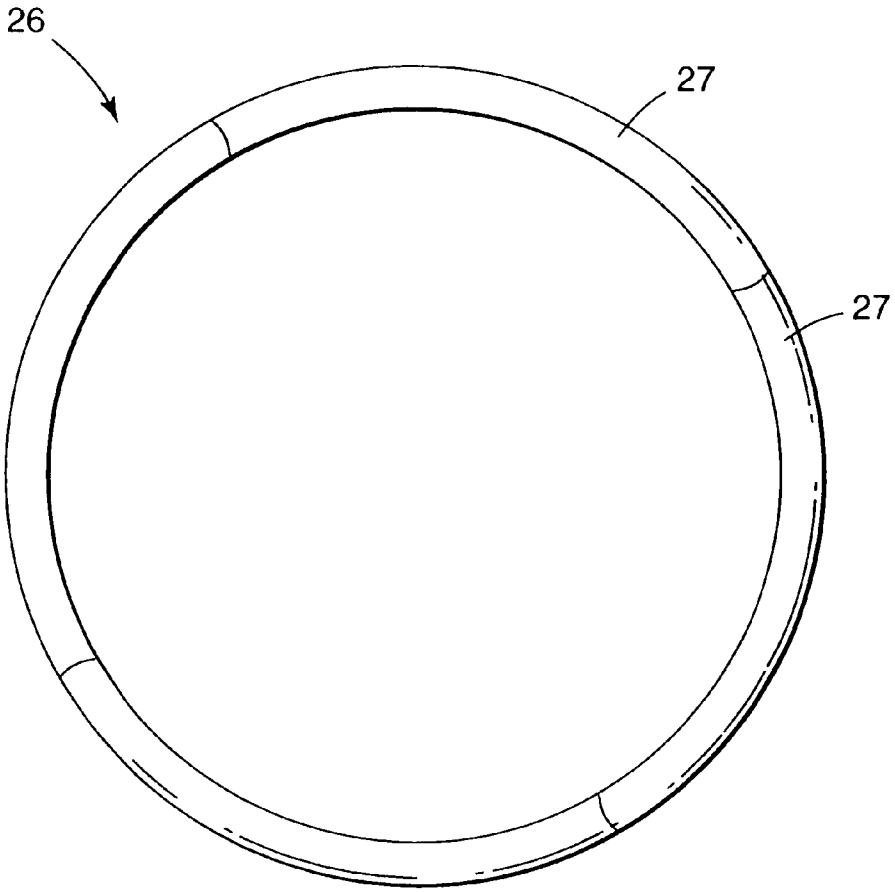
FIG. 2F is an enlarged view of the frame of the trampoline of FIG. 2A.
Figure 3A:
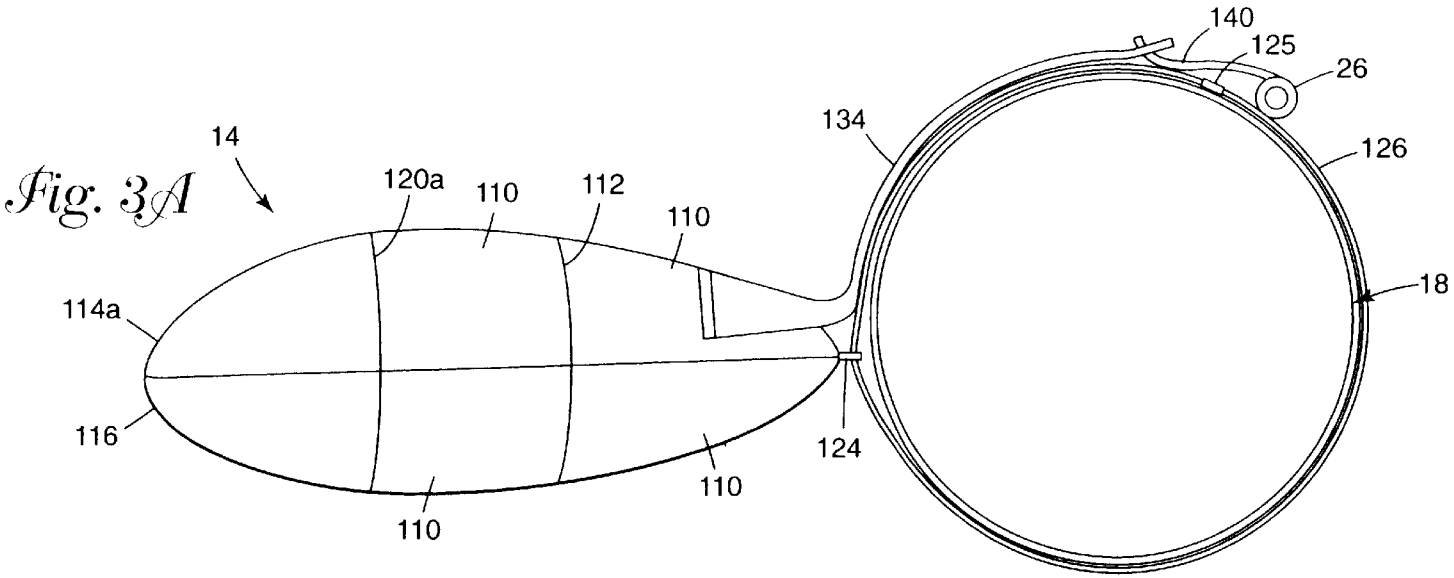
FIG. 3A is a side view of a first inflatable object attached of the park of FIG. 1.
Figure 3B:
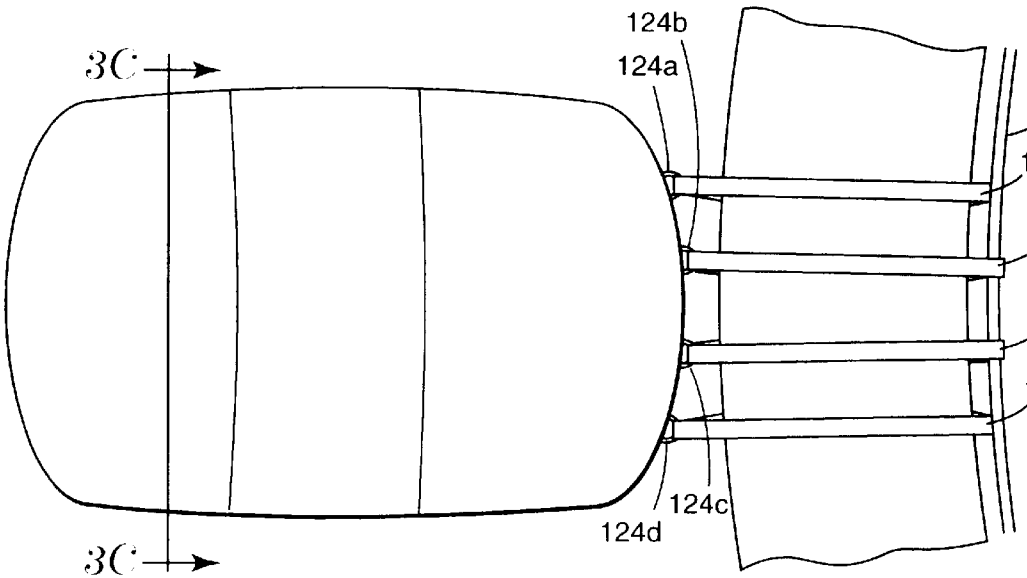
FIG. 3B is a top view of the inflatable object of FIG. 3A with the apron removed.
Figure 3C:
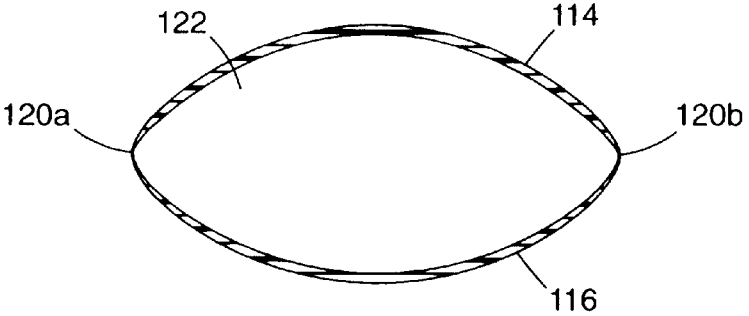
FIG. 3C is a view taken in cross-section along line A-A' of the inflatable object of FIG. 3A.
Figure 3D:
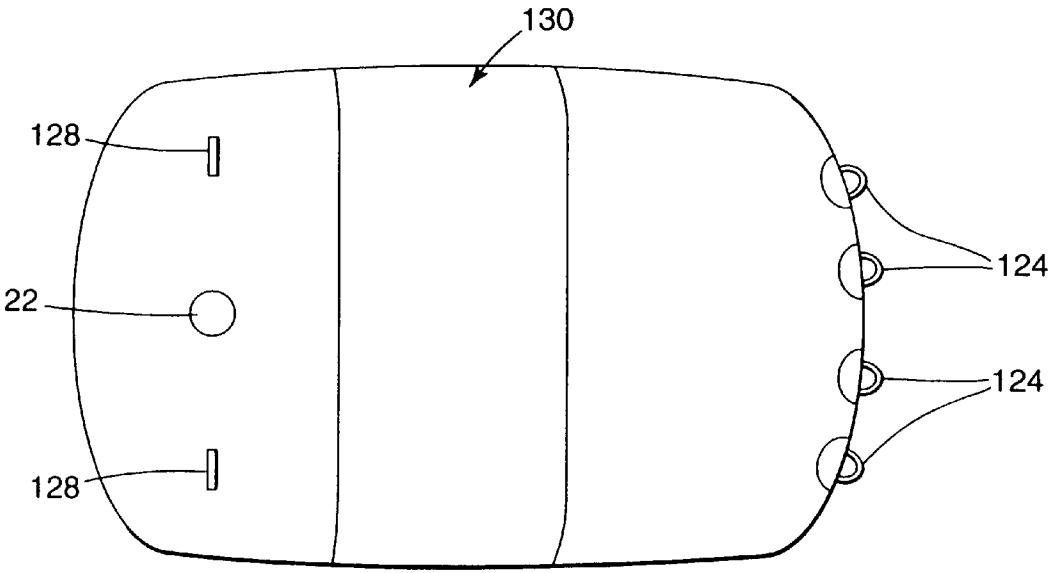
FIG. 3D is a bottom view of the inflatable object of FIG. 3A.
Figure 3E:
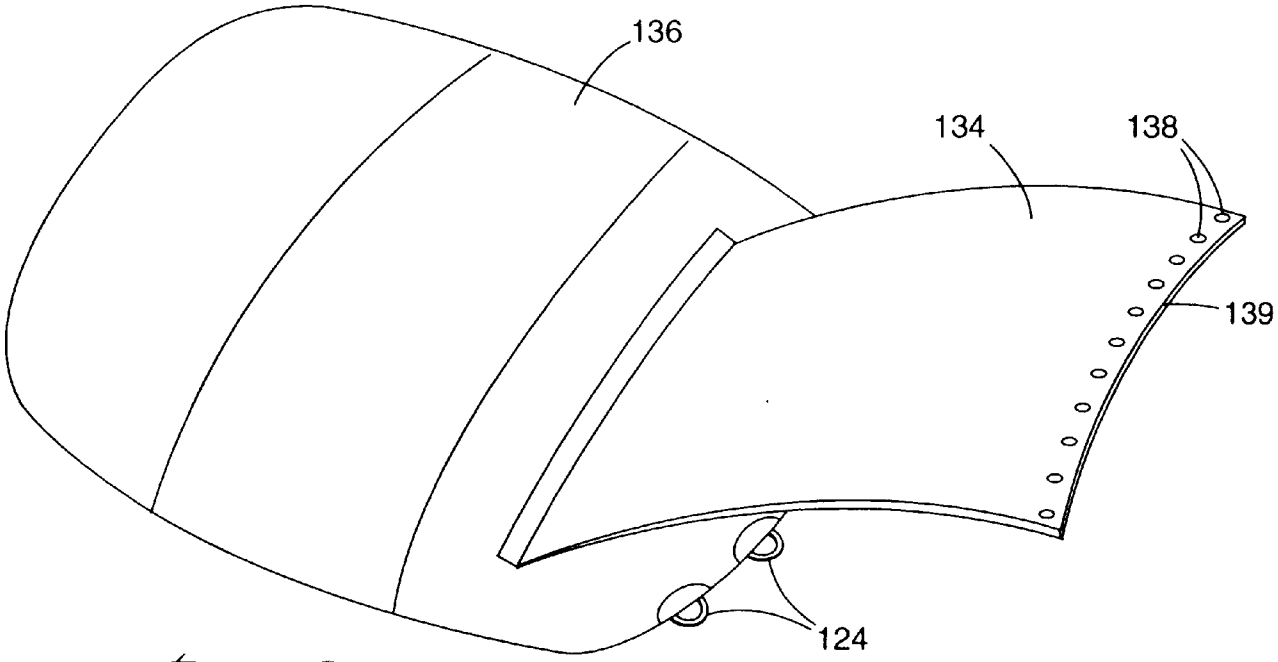
FIG. 3E is a perspective top view of the inflatable object of FIG. 3A.
Figure 3F:
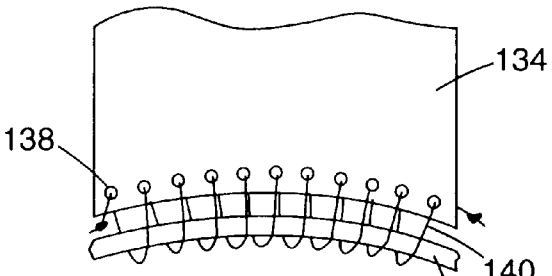
FIG. 3F is a top view depicting the attachment of the inflatable object of FIG. 3A to the trampoline of FIG. 2A.
Figure 4A:
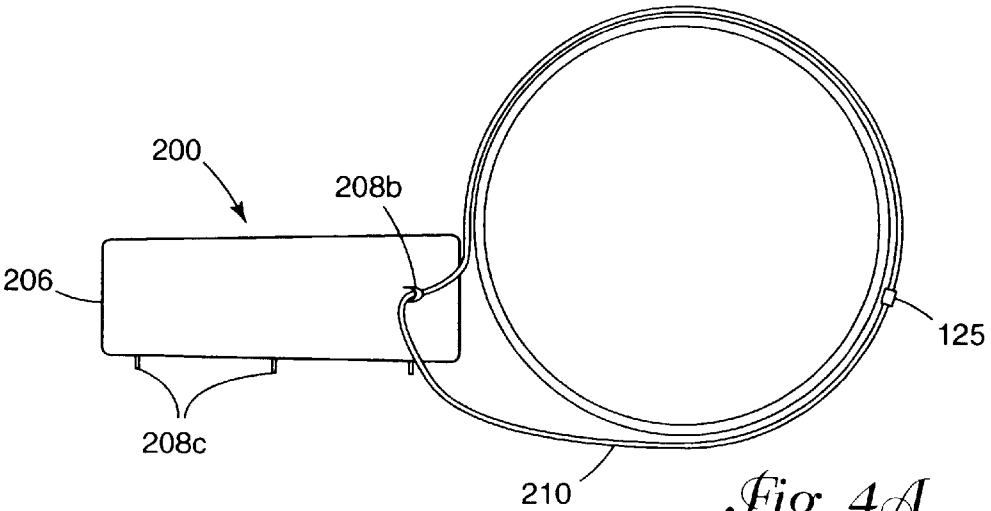
FIG. 4A is a view taken in cross-section of the second inflatable object of the water park of FIG. 1.
Figure 4D:
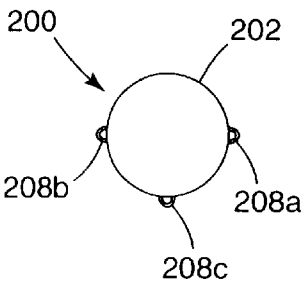
FIG. 4D is a view from a second end of the second inflatable object of FIG. 4A.
Figure 4C:
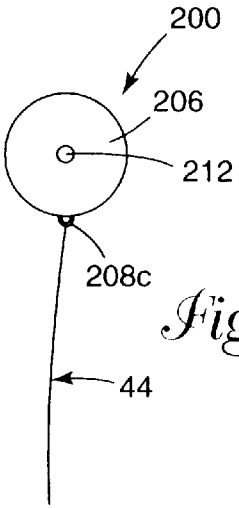
FIG. 4C is a view from one end of the second inflatable object of FIG. 4A.
Figure 4B:
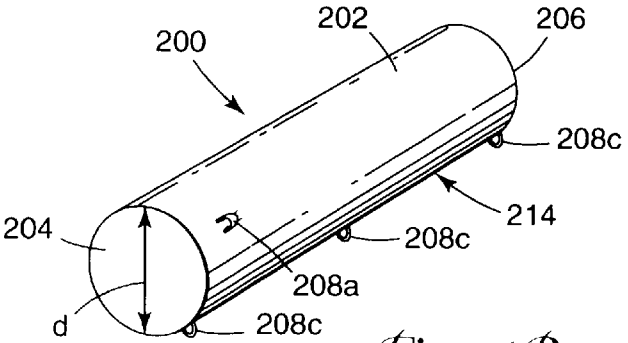
FIG. 4B is a perspective view from one end of the second inflatable object of FIG. 4A.
Figure 6D:
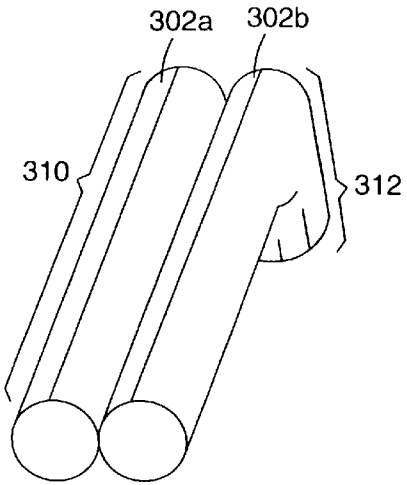
FIG. 6D is a perspective view of the two tubes of the slide of FIG. 6A.
Figure 6A:
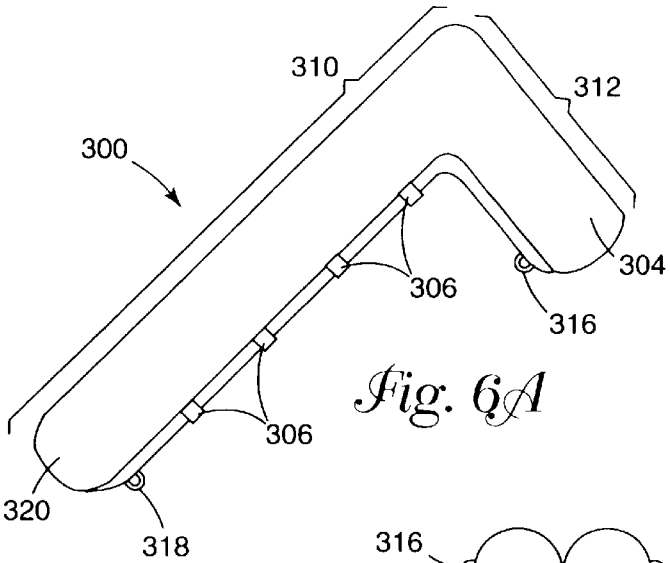
FIG. 6A is a side view of the slide of FIG. 5.
Figure 6C:
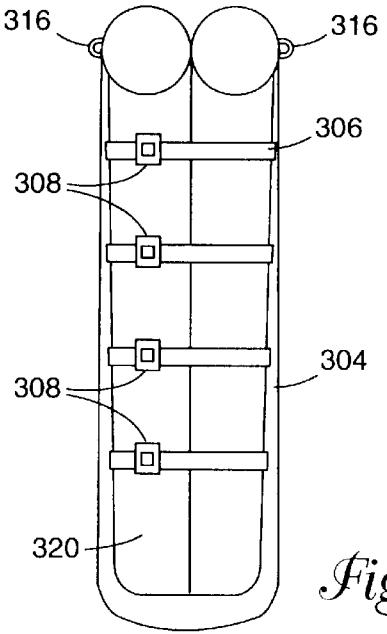
FIG. 6C is a bottom view of the slide of FIG. 6A.
Figure 6B:
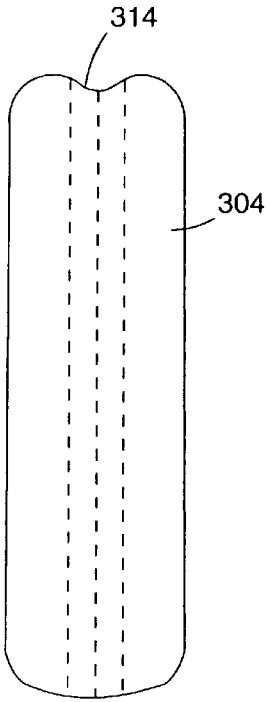
FIG. 6B is a top view of the slide of FIG. 6A.
Figure 7:
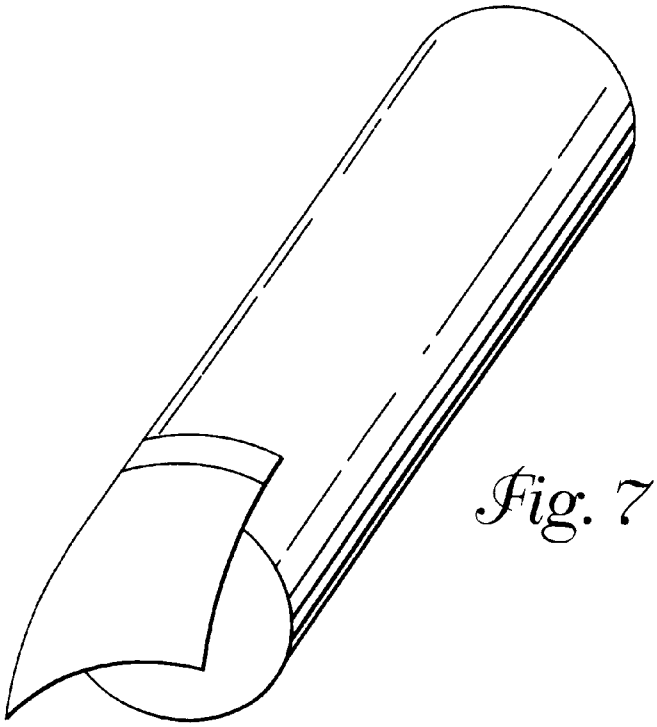
FIG. 7 is a perspective view of a cylindrical inflatable object and an apron attached thereto.
Figure 8:
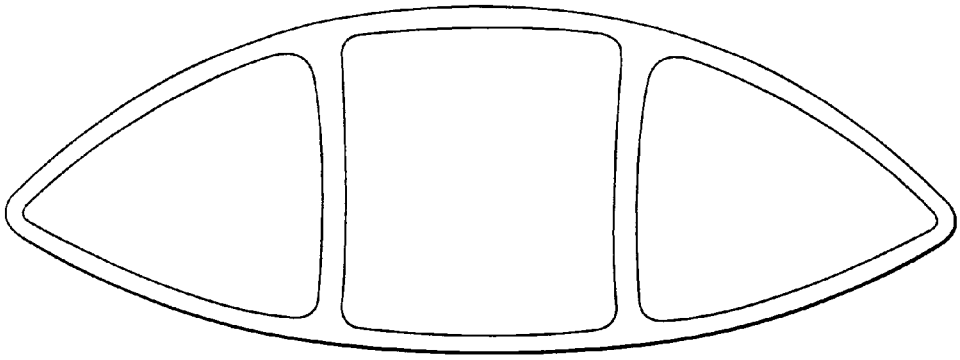
FIG. 8 is a view taken in cross section of an inflatable object that includes chambers.

The inflatable, floatable recreational park 10 includes a trampoline 12 and at least one inflatable object 14, 16 attached to the trampoline 12, as shown in FIG. 1. The park is capable of floating on water and preferably sits on the surface of a body of water such that a substantial portion of the park extends above the surface of the water.

Referring to FIGS. 1 and 2A–I, the trampoline 12 includes a continuous inflatable tube 18, which defines an aperture 20. The continuous inflatable tube 18 can include a single exterior side wall 17 defining a single chamber or an exterior side wall 17 and a number of interior side walls 19 that combine to define a number of individual chambers. Preferably the tube is polyvinyl chloride and includes multiple polyvinyl chloride panels heat welded together to define the tube.

The tube 18 is inflated by introducing air through one or more valves 22, which may also be used to deflate the tube 18. Where multiple chambers exist, each chamber can include a valve 22. Preferably the valve(s) 22 is positioned on the tube 18 such that a user of the park 10 will not contact the valve 22. For example, the valve can be positioned on the water-contacting surface 24 of the tube 18.

The annular frame 26 is coextensive with the aperture 20 of tube 18. The frame 26 can include one or more components 27 that mate together to form a circular structure. The frame 26 can sit on the surface of the tube 18 and is secured to the tube 18 by a number of ties 28 that extend from the tube 18 and are tied around the frame 26. The ties 28 can also be secured to the tube with an adhesive, stitching, heat welding, and combinations thereof. Preferably the ties 28 are secured to the tube 18 by stitching and a heat weld.

A mat 30 is attached to springs 32, which are attached to frame 26. The mat 30 provides the jumping surface of the trampoline 12. The mat 30 preferably includes at least one woven polymeric sheet.

The tube 18 includes handles 34 positioned on the exterior side wall 33 of tube 18 such that a person in the water can grab the handle 34. The handles 34 include a grip 36 extending between two secured ends 38*a–b*. The grip 36 can be of any suitable material including, e.g., a woven material, or a rope. Preferably the grip 36 is sufficiently long to permit grabbing by a user. A cylindrical plastic tube 40 can be positioned around the grip 36 to further support the grip 36 and to provide structure and wear resistance to the grip 36.

Anchor supporting rings 42 are positioned on the water-contacting surface 24 of the tube 18. The rings 42 can be of a variety of shapes, e.g., rectangular, square, triangular, circular, and D-shaped. The anchor supporting rings 42 are attached to the tube 18 with a band 39 that extends across a portion of the anchor supporting ring 42 and is secured to the tube 18 at its two ends 41*a–b* with stitching 45 and a heat welded second layer 43 of polyvinyl chloride.

Individual lines 44 are attached at one end to the anchor supporting rings 42 and at the other end to anchors 46 so as to fix the trampoline 12 in a desired location in a body of water 48.

A number of inflatable, floatable objects capable of supporting the weight of a human being on a surface thereof and having a variety of shapes and dimensions can be attached to the trampoline 12.

Referring to FIGS. 1 and 3A–F, a first inflatable object 14 in the form of a giant pillow is attached to the trampoline 12.

The pillow 14 is generally rectangular in shape and includes a number of panels 110 welded together at seams 112. The welded panels 110 combine to define sidewalls 114 and 116. Sidewalls 114, 116 are welded together at seam 120 to form a continuous wall that defines an interior chamber 122. The pillow 14 includes attachment rings 124*a–d* through which straps 126*a–d* pass. The attachment rings 124*a–d* can be of a variety of shapes, e.g., rectangular, square, triangular, circular, and D-shaped. Two straps 126*a* and 126*d* pass through the attachment rings 124*a* and 124*d*, respectively, and around tube 18 of trampoline 12. The ends of straps 126*a*, 126*d* are then fastened together through buckles 125. Two additional straps 124*b* and 126*c* pass through attachment rings 124*b* and 124*c*, respectively, and around frame 26 of trampoline 12. The ends of each strap are then fastened together through buckles (not shown). Straps 124*a–d* combine to secure the pillow 14 to the trampoline 12.

The pillow 14 also includes two anchor supporting rings 128 located on the underside 130, i.e., water-contacting side, of the pillow 14. The two anchor supporting rings 128 are spaced apart and can be used to help fix the location of the object 14 in the body of water. Lines 44 can be attached to the anchor supporting rings 128 and to an anchor 46 so as to anchor the pillow 14 in a desired position relative to the trampoline 12. The pillow 14 also includes a valve 22 for inflating and deflating the pillow 14.

An apron 134 is heat welded to the surface 136 of the pillow 14 and is dimensioned to extend from the pillow 14 to the tube 18 of the trampoline 12. Preferably the apron includes polyvinyl chloride. Holes 138 reinforced by grommets are positioned at the edge 139 of the apron 134 nearest the trampoline 12. A bungee cord 140 is then woven through the holes 138 and around the frame 26 of the trampoline 12 to secure the apron 134 to the trampoline 12. The apron 134 extends over the union between the pillow 14 and the tube 18 so as to prevent a user traveling from the trampoline 12 to the pillow 14 from falling between the pillow 14 and the tube 18 of the trampoline 12, and vice versa. The apron 134 is preferably sufficiently durable such that it is capable of catching a user and enabling the user to continue traveling to the pillow 14 or the trampoline 12 without becoming caught between the pillow 14 and the tube 18 of the trampoline 12.

A second inflatable object 200, shown in FIGS. 1 and 4A–D, is a cylindrical tube constructed to simulate a log in water and will be hereinafter referred to as a log. The log 200 is preferably constructed to support the weight of a user, more preferably the weight of an average adult male. The log 200 includes a continuous side wall 202 defining a cylinder having a diameter D, two end walls 204, 206 positioned at opposite ends of the log 200. The log 200 further includes a number of attachment rings 208*a–b* secured to the exterior side wall 202 of the log 200. Attachment rings 208*a–b* are positioned on the sidewall 202 of log 200, near the end of the log, preferably an equidistance apart from each other. Straps 210 pass through attachment rings 208*a* and 208*b* and around tube 18 of trampoline 12. The straps 210 are then secured together at buckle 125 so as to secure the log 200 to the trampoline 12. As the straps 210 are tightened, the log 200 is pulled against the tube 18. Tightening the straps 210 causes a corresponding decrease in the amount of sway in the log 200. The amount of sway will also impact the ability of a user to stand on top of the log 200 without falling off.

The log 200 also includes a valve 212 for inflating and deflating the log 200. Preferably the valve 212 is located on one of the end walls 206 of the log 200, most preferably the end wall 208 that is facing the tube 18 of the trampoline 12.

Anchor supporting rings 208*c* are positioned on the water-contacting surface 214 of the inflatable log 200. The anchor supporting rings 208*c* provide a mechanism for securing the location of log 200 in the body of water and the position of the log 200 relative to the trampoline 12. One end of a line 44 can be secured to the anchor supporting rings 208*c* and the second end of the line 44 can be secured to an anchor 46. When each of the anchor supporting rings 208*c* is secured to an anchor, the log 200 can be more permanently fixed in position relative to the trampoline 12.

Additional inflatable, floatable objects are contemplated. Referring to FIGS. 2 and 6A–D, for example, a slide 300 is shown secured to the trampoline 12. The slide 300 includes two cylindrical tubes 302*a–b* positioned adjacent one another along their longitudinal extents 310. Preferably the tubes are inflatable. The tubes 302*a–b* include a first cylindrical portion having a relatively longer longitudinal extent 310 and a second cylindrical portion having a relatively shorter longitudinal extent 312 extending at an angle to the longer longitudinal extent 310. The shorter longitudinal extent 312 extends toward and contacts the trampoline surface 50.

The two tubes 302*a–b* are enveloped by a sheet 304. Preferably the sheet is made of polyvinyl chloride. The sheet 304 surrounds the two cylindrical tubes 302*a–b* and is secured in place around the two tubes 302*a–b* with straps 306 woven through buckles 308. The sliding surface 314 formed by a combination of the sheet 304 and the longitudinal extent 310 of the cylindrical tubes 302*a–b* includes a natural depression 314, shown at FIG. 6B, at the point at which the two tubes 302*a–b* meet.

The slide 300 further includes two attachment rings 316 attached to the sides of the slide 300 near the point of contact between the shorter longitudinal extent 312 and the trampoline 12. Straps 306 pass through the attachment rings 316 and around the frame 26 of the trampoline 12. The straps 306 are pulled taught to secure the slide 306 in position against the trampoline 12.

Anchor supporting rings 318 positioned at or near the water-contacting end 320 of the slide 300 are used to anchor the slide 300. A line 44 extends from the anchor supporting ring 318 to an anchor 46 to maintain the slide's 300 position relative to the trampoline 12.

Each tube 302 of the slide 300 includes a valve 322 for inflating and deflating the tubes 302. Preferably the slide 300 is inflated by first partially inflating tubes 302, surrounding the tubes 302 with sheet 304, securing the sheet 304 around the tubes 302 with straps 306, and inflating the tubes 302*a–b* such that the sheet 304 pulls taught around the inflated tubes 302*a–b*. Once the tubes 302*a–b* are fully inflated, the straps 306 can again be pulled taught so as to tightly secure the sheet 304.

The inflatable objects can be constructed of a variety of polymers including, e.g., natural and synthetic rubber, elastomers, thermoplastic polymers, thermoplastic elastomers and combinations thereof. Preferably the objects are constructed from polyvinyl chloride.

The floatable recreational park 10 can also include a ladder 52. Preferably the ladder 52 is positioned on the trampoline 12 to assist a user in climbing to the jumping surface 30 of the trampoline 12. The ladder 52 preferably is a rigid ladder 52 that conforms to at least a portion of the curvature of the tube 18 or other inflatable object to which it is secured. An example of a suitable ladder is described in U.S. Ser. No. 09/328,155 filed Jun. 8, 1999, entitled, "Ladder," now abandoned, which is incorporated herein by reference.

Other embodiments are within the claims. For example, although the invention has been described as including a buckle at one end of the straps that are used to secure the inflatable objects to the trampoline, the strap can be secured to itself through a variety of mechanisms, e.g., by tying the two ends together; through the use of another attachment component, e.g., a two component connection (e.g., a clip) in which one of the components (e.g., a male component) is attached to a first end of the strap, a second component (e.g., a female component) is attached to a second end of the strap, and the two components mate to form a secure connection; and combinations thereof. Alternately or in addition, one of a male or female attachment component can be secured to the inflatable object, and the second of a male or female component can be attached to the strap such that the inflatable object is attached to the strap by the mating of the male and female components.

The floatable objects are preferably inflatable, however, a variety of floatable objects including non-inflatable objects can be included in the park.

What is claimed is:

1. A floatable park comprising:

a) a trampoline comprising
   i) an inflatable tube, and
   ii) a mat secured to said inflatable tube to provide a jumping surface;

b) a first inflatable object attached to said trampoline, said first inflatable object constructed to support a human being thereon; and c) an apron attached to said first inflatable object and extending from said first inflatable object to said trampoline, said park being floatable on water.

2. The park of claim 1, further comprising a strap extending from said first inflatable object to said trampoline.

3. The park of claim 2, wherein said strap extends in a loop around said trampoline.

4. The park of claim 2, further comprising a buckle secured to one end of said strap.

5. The park of claim 1, wherein said fist inflatable object further comprises a plurality of rings secured to said first inflatable object, and a plurality of straps, wherein individual straps pass through individual rings and are secured to said trampoline.

6. The park of claim 5, wherein at least one of said straps extends in a loop around said trampoline.

7. The park of claim 5, wherein said rings define a shape selected from the group consisting of rectangle, square, triangle, D, and circle.

8. The park of claim 1, wherein said first inflatable object further comprises a first component for attaching said first object to said trampoline, said first component being attached to said first object.

9. The park of claim 8, wherein said first component is selected from the group consisting of a male component and a female component.

10. The park of claim 9, further comprising a strap having a first end and a second end, and a second component secured to said first end of said strap and being capable of connecting with said first component.

11. The park of claim 1, wherein said first inflatable object further comprises an anchor secured to said first inflatable object.

12. The park of claim 1, wherein said first inflatable object further comprises an anchoring ring attached to a water-contacting surface of said first inflatable object.

13. The park of claim 12, further comprising an anchor and a line extending from said anchoring ring to said anchor.

14. The park of claim 1, wherein said first inflatable object is cylindrical in shape.

15. The park of claim 1, wherein said first inflatable object is pillow shaped.

16. The park of claim 1, wherein said first inflatable object comprises a plurality of chambers.

17. The park of claim 1, further comprising a line, said line passing through holes in said apron to said trampoline so as to attach said apron to said trampoline.

18. The device of claim 1, further comprising an inflatable slide.

19. The park of claim 1, further comprising a ladder attached to said trampoline, said ladder having a curved portion and a substantially linear portion.

20. The park of claim 1, further comprising a second inflatable object secured to said trampoline, said second inflatable object being constructed to support a human being positioned thereon.

21. The park of claim 20, wherein said second inflatable object is in the shape of a cylinder.

22. The park of claim 20, wherein the shape of said second inflatable object is different from the shape of said first inflatable object.

23. The park of claim 1, wherein said inflatable tube comprises a continuous inflatable tube defining an aperture and said trampoline further comprises:

an annular frame coextensive with the aperture, said annular frame being attached to said continuous inflatable tube; and a mat attached to said frame, said mat extending across the aperture.

24. The park of claim 23, further comprising a strap extending from said first inflatable object and around said tube.

25. The park of claim 23, further comprising a strap extending from said first inflatable object and to said frame.

26. The park of claim 23, further comprising a first strap extending from said first inflatable object and around said continuous inflatable tube, and a second strap extending from said first inflatable object and around said frame.

27. The park of claim 23, wherein said continuous tube comprises a plurality of chambers.

28. The park of claim 1, further comprising a frame a line passing through holes in said apron and around said frame.

29. A method of using the floatable park of claim 1, said method comprising:

placing said floatable park on a body of water.

30. The method of claim 29, further comprising contacting a surface of said trampoline with a human being.

31. A slide comprising:

a first floatable member;

a second floatable member adjacent said first floatable member;

a sheet extending across said first floatable member and said second floatable member to provide a sliding surface, said first floatable member and said second floatable member being positioned beneath said sliding surface; and a strap extending from a first edge of said sheet to a second edge of said sheet.

32. The slide of claim 31, wherein said first floatable member comprises a cylinder.

33. The slide of claim 31, wherein said first floatable member comprises an inflatable tube.

34. The slide of claim 31, wherein said first floatable member comprises a first cylindrical portion and a second cylindrical portion extending at an angle to said first cylindrical portion.

35. The slide of claim 34, wherein said second floatable member comprises a first cylindrical portion and a second cylindrical portion extending at an angle to said first cylindrical portion.

36. The slide of claim 31, wherein said strap is attached to said first edge of said sheet and said second edge of said sheet.

37. The slide of claim 31 further comprising an attachment ring secured to said first floatable member.

38. The slide of claim 31 wherein said first floatable member is inflatable and said second floatable member is inflatable.

39. A slide comprising:

a first floatable member comprising a first cylindrical member having a first end and a second end;

a second floatable member adjacent said first floatable member, said second floatable member comprising a first cylindrical member having a first end and a second end; and a sheet extending from said first floatable member to said second floatable member, around said first end of said first floatable member, and around said first end of said second floatable member to provide a sliding surface.

40. The slide of claim 39, wherein said first floatable member further comprises a second cylindrical member extending at an angle to one of said first end and said second end of said first cylindrical member of said first floatable member; and said second floatable member further comprises a second cylindrical member extending at an angle to one of said first end and said second end of said first cylindrical member of said second floatable member.

41. The slide of claim 40 wherein said sheet extends around said second cylindrical member of said first floatable member, and around said second cylindrical member of said second floatable member.

42. The slide of claim 39, wherein said sheet extends around said second end of said first floatable member and around said second end of said second floatable member.

43. The slide of claim 39, further comprising a strap attached to a first edge of said sheet and a second edge of said sheet.

44. A floatable park comprising:

a) a trampoline comprising i) an inflatable tube, and ii) a mat secured to said inflatable tube to provide a jumping surface;

b) a first inflatable object attached to said trampoline, said first inflatable object constructed to support a human being thereon;

c) a strap extending from said first inflatable object in a loop around said trampoline; and d) an apron attached to said first inflatable object, said park being floatable on water.

45. The park of claim 44, further comprising a buckle secured to one end of said strap.

46. A floatable park comprising:

a) a trampoline comprising i) an inflatable tube, and ii) a mat secured to said inflatable tube to provide a jumping surface;

b) a first inflatable object attached to said trampoline, said first inflatable object constructed to support a human being thereon;

c) a plurality of rings secured to said first inflatable object;

d) a plurality of straps, wherein individual straps pass through individual rings and are secured to said trampoline; and e) an apron attached to said first inflatable object, said park being floatable on water.

47. The park of claim 46 wherein at least one of said straps extends in a loop around said trampoline.

48. The park of claim 46, wherein said rings define a shape selected from the group consisting of rectangle, square, triangle, D, and circle.

49. A floatable park comprising:

a) a trampoline comprising i) an inflatable tube, and ii) a mat secured to said inflatable tube to provide a jumping surface;

b) a first inflatable object attached to said trampoline, said first inflatable object constructed to support a human being thereon, said first inflatable object comprising a first component for attaching said first object to said trampoline, said first component being attached to said first object and being selected from the group consisting of a male component and a female component; and c) an apron attached to said first inflatable object, said park being floatable on water.

50. The park of claim 49, further comprising a strap having a first end and a second end, and a second component secured to said first end of said strap and being capable of connecting with said first component.

51. A floatable park comprising:

a) a trampoline comprising i) an inflatable tube, and ii) a mat secured to said inflatable tube to provide a jumping surface;

b) a first inflatable object attached to said trampoline, said first inflatable object constructed to support a human being thereon;

c) an apron attached to said first inflatable object; and d) an inflatable slide, said park being floatable on water.

52. A floatable park comprising:

a) a trampoline comprising i) a continuous inflatable tube defining an aperture, ii) an annular frame coextensive with the aperture, said annular frame being attached to said continuous inflatable tube; and iii) a mat attached to said frame and extending across the aperture, said mat providing a jumping surface;

b) a first inflatable object attached to said trampoline, said first inflatable object constructed to support a human being thereon;

c) an apron attached to said first inflatable object; and d) a strap extending from said first inflatable object and around said inflatable tube, said park being floatable on water.

53. A floatable park comprising:

a) a trampoline comprising i) a continuous inflatable tube defining an aperture, ii) an annular frame coextensive with the aperture, said annular frame being attached to said continuous inflatable tube; and iii) a mat attached to said frame and extending across the aperture, said mat providing a jumping surface;

b) a first inflatable object attached to said trampoline, said first inflatable object being constructed to support a human being thereon;

c) an apron attached to said first inflatable object; and d) a strap extending from said first inflatable object to said frame, said park being floatable on water.

54. A floatable park comprising:

a) a trampoline comprising i) a continuous inflatable tube defining an aperture, ii) an annular fame coextensive with the aperture, said annular frame being attached to said continuous inflatable tube; and iii) a mat attached to said frame and extending across the aperture, said mat providing a jumping surface;

b) a first inflatable object attached to said trampoline, said first inflatable object being constructed to support a human being thereon;

c) an apron attached to said first inflatable object; and d) a first strap extending from said first inflatable object and around said continuous inflatable tube, and a second strap extending from said first inflatable object and around said frame, said park being floatable on water.

55. A floatable park comprising:

a) a trampoline comprising i) an inflatable tube, ii) a mat secured to said inflatable tube to provide a jumping surface, and iii) a frame attached to said inflatable tube and said mat;

b) a first inflatable object attached to said trampoline, said first inflatable object constructed to support a human being thereon;

d) an apron attached to said first inflatable object; and e) a line passing through holes in said apron and around said frame, said park being floatable on water.

* * * * *